US006354359B2

(12) United States Patent
Perrella et al.

(10) Patent No.: US 6,354,359 B2
(45) Date of Patent: Mar. 12, 2002

(54) METHOD FOR CLEANING AND LUBRICATING AN INJECTION SLEEVE AND PLUNGER IN A COLD CHAMBER INJECTION UNIT

(75) Inventors: Guido Perrella, Westmount; Jean Coronado, St-Eustache, both of (CA)

(73) Assignee: DBM Industries Ltd., Quebec (CA)

( * ) Notice: Subject to any disclaimer, the term of this patent is extended or adjusted under 35 U.S.C. 154(b) by 0 days.

(21) Appl. No.: 09/804,353

(22) Filed: Mar. 12, 2001

Related U.S. Application Data

(62) Division of application No. 09/223,117, filed on Dec. 30, 1998, now Pat. No. 6,237,672.

(51) Int. Cl.[7] ..... B22D 17/08

(52) U.S. Cl. ..... 164/72; 164/149; 164/158; 164/312

(58) Field of Search ..... 164/72, 149, 312, 164/158, 472, 268; 425/DIG. 228

(56) References Cited

U.S. PATENT DOCUMENTS

| | | | | |
|---|---|---|---|---|
| 3,171,172 | A | 3/1965 | Becker | 164/149 |
| 3,613,772 | A | 10/1971 | Carr | 164/149 |
| 3,767,012 | A | 10/1973 | Jimi et al. | 184/5 |
| 3,920,099 | A | 11/1975 | Pondelicek et al. | 184/55.2 |
| 4,420,028 | A | 12/1983 | Nelson | 164/149 |
| 4,664,173 | A | 5/1987 | Wolniak | 164/312 |
| 4,899,804 | A | 2/1990 | Hammerer | 164/312 |
| 5,076,343 | A | 12/1991 | Sandercock | 164/267 |
| 5,370,171 | A | 12/1994 | Fields et al. | 164/312 |
| 5,388,631 | A | 2/1995 | Suganuma et al. | 164/72 |
| 5,435,373 | A | 7/1995 | Drane et al. | 164/72 |
| 5,881,797 | A | 3/1999 | Hansen | 164/187 |

FOREIGN PATENT DOCUMENTS

| | | |
|---|---|---|
| DE | 1 184 907 | 1/1965 |
| EP | 625389 | 11/1994 |
| JP | 197803 | 3/1978 |
| JP | 6-122058 | 5/1994 |
| SU | 548 368 | 3/1977 |

*Primary Examiner*—M. Alexandra Elve
*Assistant Examiner*—Kevin P. Kerns
(74) *Attorney, Agent, or Firm*—McCormick, Paulding & Huber LLP

(57) ABSTRACT

A method for cleaning and lubricating an injection sleeve and plunger tip during a fill and injection cycle in a cold chamber die casting machine, in which the plunger tip has an annular generally arcuate recess, lubricating nozzles, lubricating conduits, and scrap exhaust conduits. Pressurized air is released into the recess during the injection cycle and debris is exhausted through the scrap exhaust conduits. Upon completion of the injection cycle, the release of pressurized air into the recess is terminated. A mixture of pressurized air and lubricant is released through the recess onto the injection sleeve during the withdrawal cycle. Upon completion of the withdrawal cycle, release of the mixture of pressurized air and lubricant into the recess is terminated.

16 Claims, 5 Drawing Sheets

A
34
26
37
30
9
29
35
8
34
33
32
28
24
26
16
27
36
25
6
14
20
19
18
15
17

METHOD FOR CLEANING AND LUBRICATING AN INJECTION SLEEVE AND PLUNGER IN A COLD CHAMBER INJECTION UNIT

CROSS-REFERENCE TO RELATED APPLICATION

This application is a divisional of U.S. patent application Ser. No. 09/223,117 filed on Dec. 30, 1998, now U.S. Pat. No. 6,237,672, entitled "SELF LUBRICATING AND CLEANING INJECTION PISTON FOR COLD CHAMBER INJECTION UNIT", and which is herein incorporated by reference.

FIELD OF THE INVENTION

This invention is in the field of cold chamber die casting machines. More particularly, the invention relates to an injection piston which provides improved injection, lubrication and cleaning of the injection sleeve.

BACKGROUND OF THE INVENTION

The injection piston is comprised of a plunger tip, plunger tip ring, a cap to retain the plunger piston ring on the plunger tip, a lubricating chamber and a scraper and guide ring. The cap, plunger piston ring and scraper and guide ring are fastened to the plunger tip. An annular arcuate recess about the circumference of the plunger tip in combination with a series of tilted and radial lubrication nozzles form a lubrication chamber within the injection sleeve. The extent of the lubrication chamber enables a substantial portion of injection sleeve to be directly lubricated before withdrawal of the plunger tip in the injection sleeve in preparation for the filling cycle.

In cold chamber die casting, the injection piston is located within the injection sleeve of the cold chamber die casting unit. The injection piston is connected by a connecting rod to an injection piston rod to an injection unit piston. The withdrawal of the injection unit piston results in the withdrawal of the injection piston within the injection sleeve to a fill position. In the fill position molten metal is poured into the space in the injection sleeve above the injection piston. Once the dies of the cold chamber die casting machine are closed and clamped, the injection cycle is commenced. In the injection cycle, the injection unit piston drives the piston rod, connection rod and injection piston upwardly within the injection sleeve transporting the molten metal in the injection sleeve into the runners and die cavities. As soon as the molten metal in the dies is firm, the injection unit piston withdraws the injection piston to the fill position within the injection sleeve in position for commencement of the subsequent cycle.

One problem associated with cold chamber die casting machines is that during the injection cycle small amounts of molten metal escape between the inside of the injection sleeve and the injection piston or through a piston ring and form scrap on the interior of the injection sleeve. The problem results from the inside diameter of the injection sleeve expanding and contracting because of thermal expansion caused by receipt of molten metal followed by relative cooling during the injection cycle when the molten metal is removed from the injection sleeve. The injection plunger is also subject to expansion and contraction. Piston rings are also subject to thermal expansion and contraction which may result in a gap through a split ring or rings for the molten metal. It is important that scrap formed from metal be removed from the interior of the injection sleeve to prevent scoring of the injection sleeve which aggravates the problem. Scrap not removed when the injection piston is withdrawn from the interior of the injection sleeve may be removed in the injection cycle and enclosed in a casting resulting in a possible reject.

Another problem associated with cold chamber die casting machines is that the injection piston or the piston ring of the injection piston must be in sliding contact with the surface of the injection sleeve to prevent some molten metal under pressure from escaping between the injection piston and the injection sleeve. The injection piston contacts the injection sleeve during the withdrawal stroke as well as the injection stroke. It is necessary to lubricate the injection piston to prevent wear and lessen scoring by contact movement of the injection piston on the surface of the injection sleeve.

U.S. Pat. No. 5,076,343 discloses a die cast plunger lubrication system. The plunger tip includes a lube groove through which lubrication is forced out on the forward stroke. The disclosure states that the lubricant may be output to the outer surface of the plunger rod instead of through a lube groove. U.S. Pat. No. 4,420,028 discloses an orifice located adjacent to the piston head.

In both the above inventions there is a substantial area of the plunger tip or piston head in contact with the interior of the sleeve. In both patents the lube groove or lube orifice is very small in comparison to the length of the plunger tip.

The plunger tip of the instant invention does not contact the surface of the injection sleeve. The plunger piston ring which is located in an annular recess on the front outside surface of the plunger tip is the first part of the injection piston in permanent contact with the interior of the injection sleeve, the second part is a scraper and guide ring located in an annular recess on the rear side of the plunger tip. The plunger piston ring is retained in the annular recess on the plunger tip by a cap in the form of a disc fastened to the face of the plunger tip. The contact surface between the surface of injection piston and the surface of the injection sleeve is the outer surface of the plunger piston ring. The contact surface of the plunger piston ring is substantially less than that of the contact surface between the plunger or plunger tips disclosed in the above patent. The lubrication chamber and associated annular radial and tilted pressurized air and lubrication nozzles apply pressurized air and lubrication directly to a substantial portion of the injection sleeve initiated upon withdrawal of the injection piston.

Japanese Patent 8,068,257 discloses the use of a series of split rings located side by side on a plunger tip to decrease the surface to surface contact between the injection plunger and injection sleeve. The plunger piston ring of the instant invention does not provide a continuous passage through the ring as does a split ring. The plunger piston ring of this invention is comprised of a ring of tool steel in which a series of parallel alternately disposed inclined slots are cut alternately in the front side and rear side of a ring of tool steel. The inclined slots proceed two-thirds to three-quarters of the distance through the plunger piston ring. The parallel alternate inclined slots result in a plunger piston ring which is flexible without providing any opening extending completely through the plunger piston ring. The plunger piston ring acts as a guide for the plunger tip which is not in contact with the inside of the injection sleeve. The surface area of the plunger piston ring in contact with the surface of the injection sleeve in less than the surface contact of plunger, plunger tips, combined plunger tips and rings or series of plunger split rings used in combination disclosed in the prior art. The lesser surface area contact results in less metal to metal contact between the injection piston and the injection sleeve during each cycle.

SUMMARY OF THE INVENTION

The injection plunger of this invention provides a plunger tip having an annular lubricating chamber commencing behind the plunger piston ring. Forwardly tilted nozzle holes blow pressurized lubricant and air at the interior of the injection sleeve in the vicinity of the plunger piston ring. Radial nozzle holes blow pressurized lubricant and air directly at the surface of the injection sleeve are also located within the annular lubricating chamber. The lubrication and pressurized air blow commences while withdrawal of the injection plunger is initiated and terminates when the injection plunger reaches the fill position. The combined use of tilted and radial nozzles located annularly within the lubricating chamber provides lubrication directly at the surface of the injection sleeve facing the annular lubricating chamber.

Immediately to the rear of the lubricating chamber is a scraper and guide ring whose outer diameter is less than the inside diameter of the injection sleeve. The scraper and guide ring serves to remove metal scores located on the inner wall of the injection sleeve. The rear of the lubricating chamber is vented to the outside by a series of circular openings defining cylindrical conduits through the back of the plunger tip. The series of cylindrical conduits have longitudinal centerlines parallel to the longitudinal centerline of the plunger tip, said apertures being equally spaced about the longitudinal centerline of the plunger tip commencing at the back of the lubricating chamber.

During the injection cycle as the plunger tip moves forward the scraper and guide ring removes scores from the inside of the injection sleeve which fall into the lubrication chamber. Upon initiation of piston withdrawal, lubrication and pressurized air are blown through the tilted and radial nozzles into the lubricating chamber thus driving scrap and loose lubricant out the scrap conduits in the rear of the lubricating chamber.

The injection piston and more particularly the plunger tip, plunger piston ring and cap decrease the amount of molten metal passing by or through the plunger, plunger tip or plunger piston ring resulting in a cleaner surface on the interior of the injection sleeve. The application of lubrication directly to a substantial length of the injection sleeve facing the lubricating chamber commencing proximate the plunger piston ring sleeve decreases the wear on the plunger piston ring and the surface of the injection sleeve. The quality of castings is improved by decreasing solid impurities within the injection sleeve resulting from little molten metal passing between the plunger ring and the injection sleeve combined with improved removal of solids.

DETAILED DESCRIPTION

Figure 1:
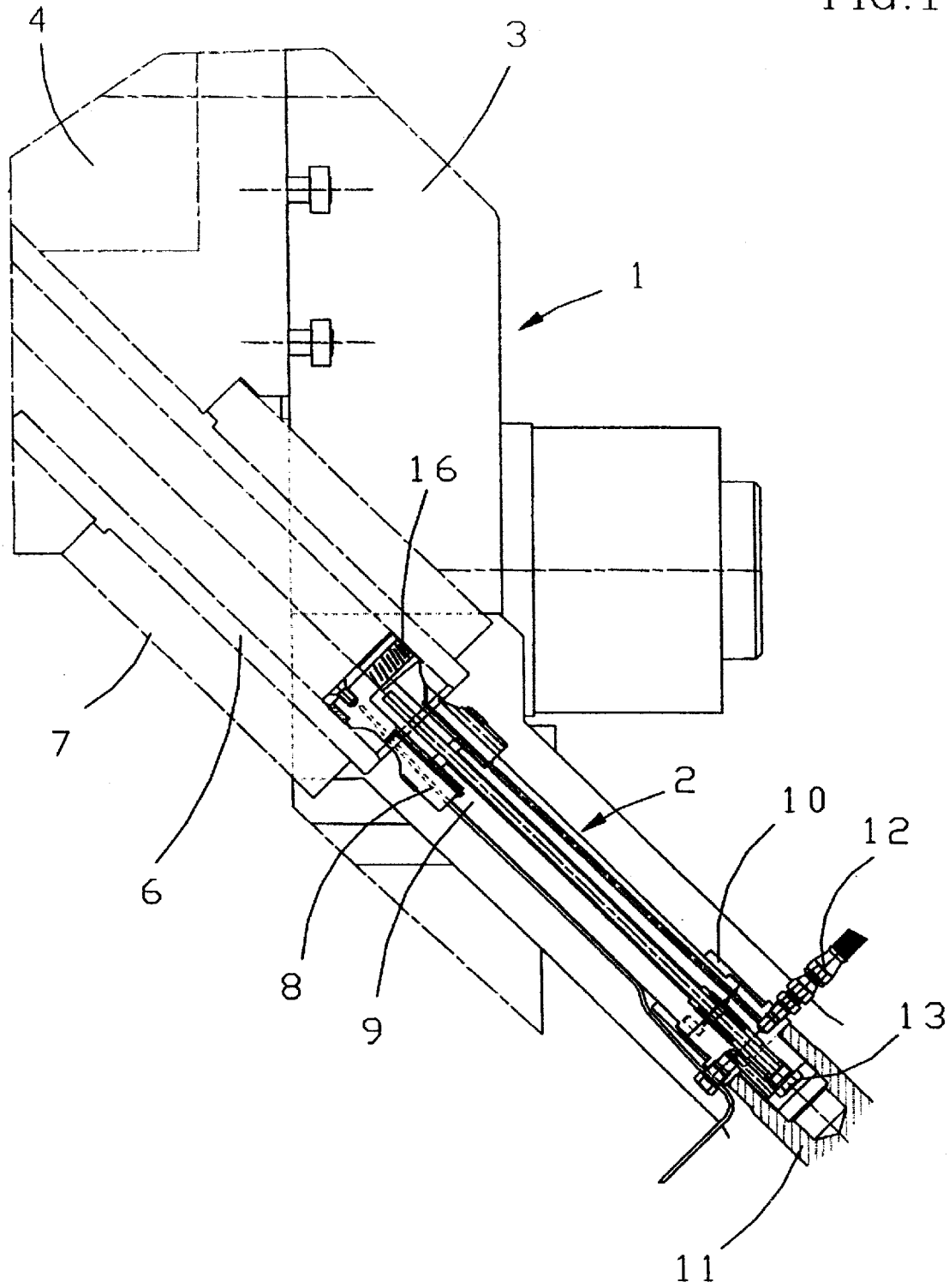
FIG. 1 is a cross-sectional view of the principle parts of the injection system of a cold chamber die casting machine with the injection piston in retracted position prior to receipt of the molten metal.
Figure 2:
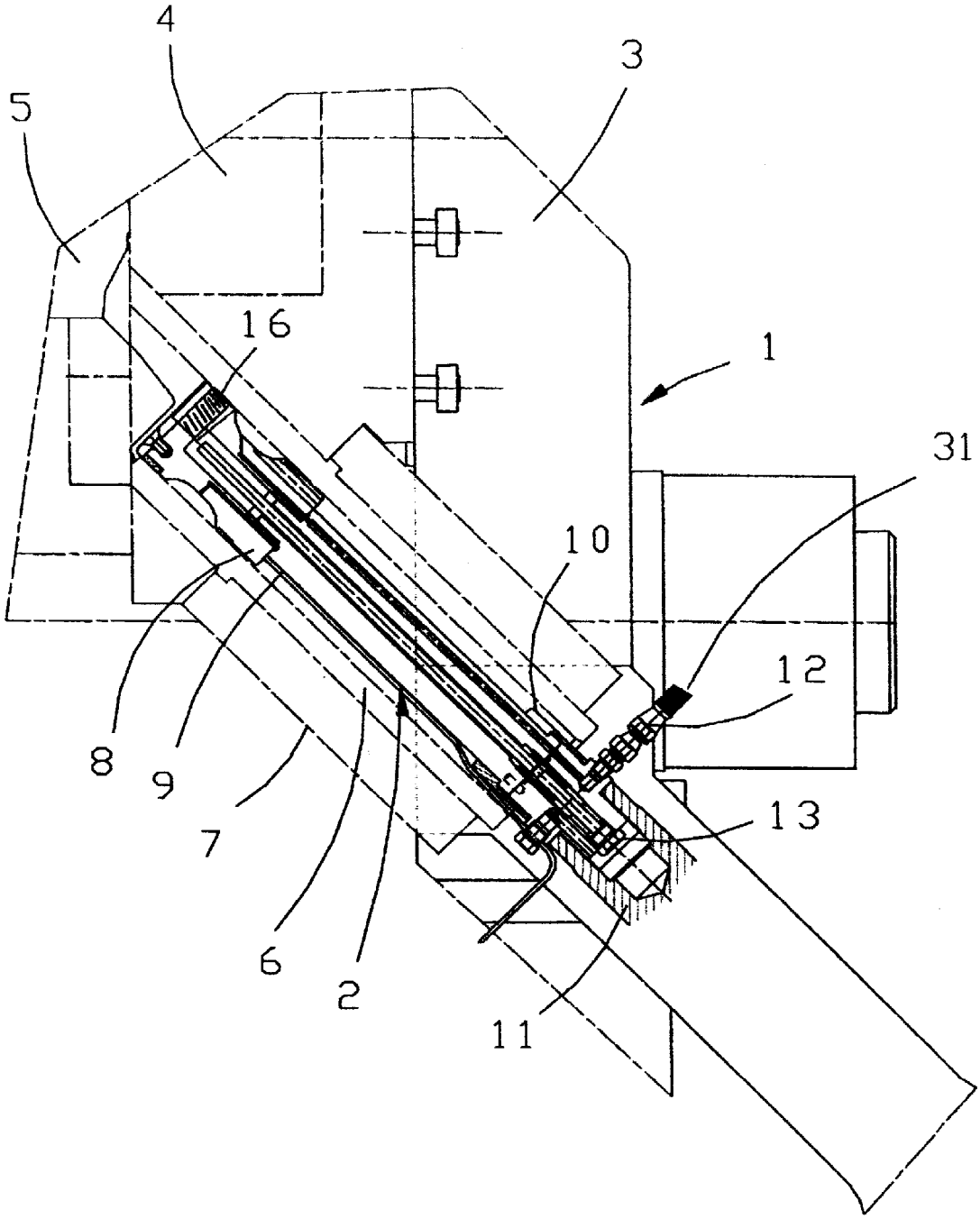
FIG. 2 is a cross-sectional view of the injection system of the cold chamber die casting machine of FIG. 1 with the injection piston in the forward position after having forced the molten metal into the runners and die cavities.

Referring to FIG. 1 there is shown a portion of a cold chamber die casting machine 1 and an injection unit 2 for the cold chamber die casting machine. The portion of the cold chamber die casting machine 1 shown in FIG. 1 is the stationary right hand side platen 3. The stationary die half 4 is mounted on the stationary right hand side platen 3. FIG. 2 shows the travelling left hand side platen and the travelling die half 5 in closed position in contact with stationary die half 4. The injection sleeve 6 inclines upwardly within the stationary right hand side platen 3 and ends inside the base of stationary die half 4. Injection sleeve clamp 7 maintains the injection sleeve 6 in position in the stationary right hand side die half 4. In FIG. 1 the plunger tip 8 of injection unit 2 is shown near the bottom of injection sleeve 6 in the lower or filling position. The plunger tip 8 is connected by connecting rod 9 to saddle 10 of injection unit 2. The saddle 10 is in turn connected to injection piston rod 11 which in turn is fastened to the injection unit piston for the injection unit 2, which piston is not shown. The saddle 10 receives a flexible hose 12 for carrying plunger tip coolant through the saddle 10. Connector nut 13 is the coolant plug.

Figures 3, 4:
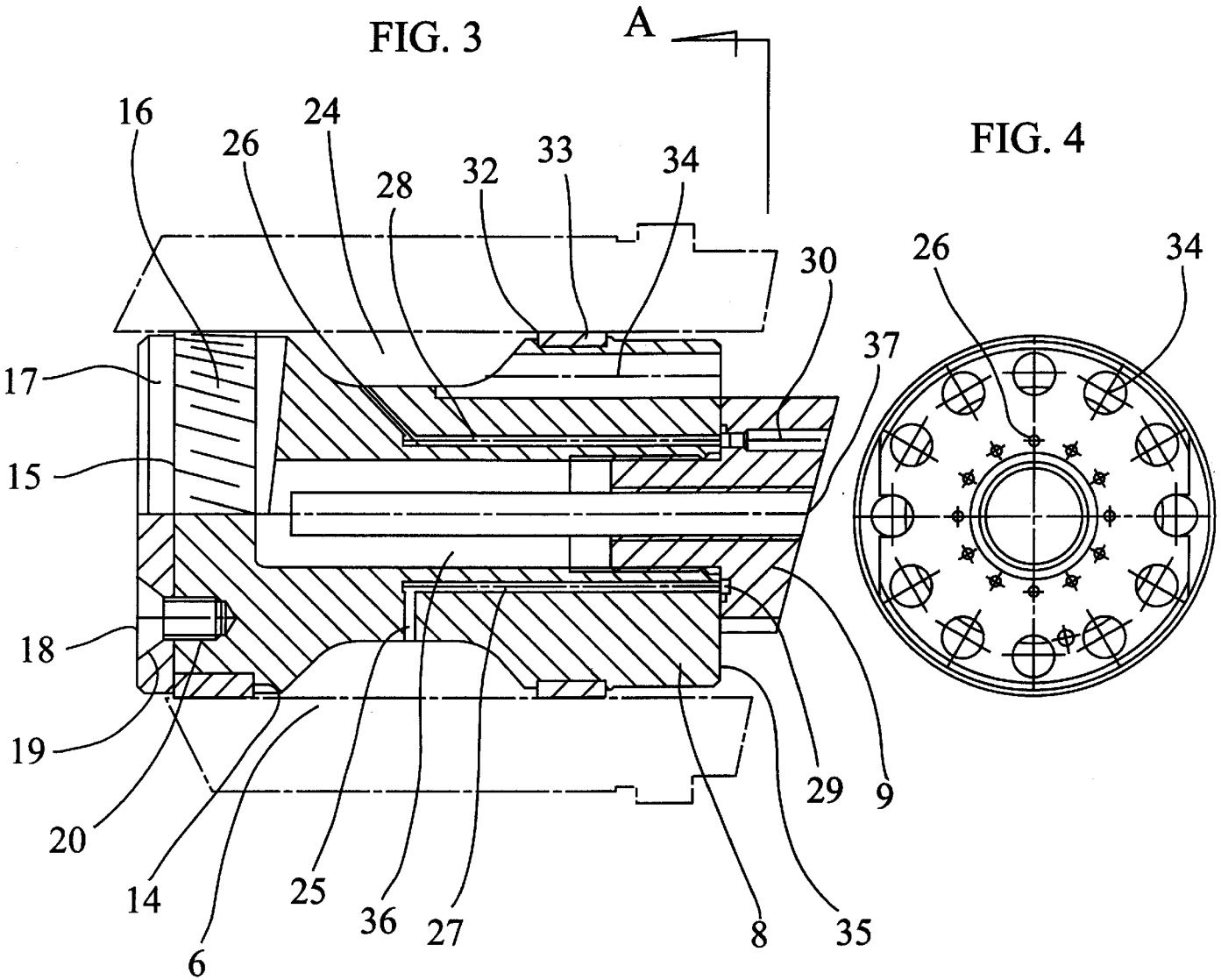
FIG. 3 is a partial side and cross-sectional view of the connecting rod, plunger tip, plunger piston ring, and cap with the retaining bolts retaining the cap on the face of the plunger tip and front side of the plunger piston ring.
FIG. 4 is a rear view of the back of the plunger tip of FIG. 3 disclosing a series of scrap exhaust holes.

As seen in FIG. 3 the plunger tip 8 has an annular recess 14 about the exterior of the front face 15 of the plunger tip 8. The plunger piston ring 16 is located in the annular recess 14. The outside diameter of the plunger piston ring 16 is greater than the outside diameter of the plunger tip 8 and in fixed and moving contact with the inside of the injection sleeve 6. The injection piston ring 16 is maintained in the annular recess 14 by the cap 17 which is secured to the face 15 of the plunger tip 8 by threaded retaining bolts 18 which are placed in openings defining apertures 19 in cap 17 and secured in openings defining threaded apertures 20 located on the face 15 of the plunger tip 8.

Referring to FIG. 3 the side of the plunger tip 8 includes an annular recess 14 commencing behind the plunger piston ring 16 and extending for over a third of the length of the plunger tip 8. When the plunger tip 8 is placed in the injection sleeve 6 as seen in FIG. 3, the annular groove creates a lubrication chamber 24. A series of radial lubrication and air nozzles 25 are located annularly about the longitudinal centerline of the plunger tip 8. A series of forwardly inclined lubrication and air nozzles 26 are also located annularly facing towards the front of the plunger tip 8. The radial lubrication and air nozzles 25 and the inclined lubrication and air nozzles 26 are connected through lubrication and air conduits 27 and 28 to the same annular lubrication and air supply conduit 29 located on a front surface of the connecting rod 9. The annular lubrication and air supply conduit 29 is connected through the connecting rod lubrication and supply conduit 30 to the pressurized lubricant and air supply in the saddle 10 which in turn is supplied through the flexible hose for pressurized lubricant and air supply 31.

An annular scraper and guide ring recess 32 located near the rear or the plunger tip 8 immediately behind the lubrication and air chamber 24 has a scraper and guide ring 33 mounted therein. The outside diameter of the scraper and guide ring 33 is slightly less than the inner diameter of the injection sleeve 6. The scraper and guide ring is split in half by an inclined slot. The scraper and guide ring is mounted on the plunger tip 8 in an annular recess on the plunger tip. The inclined slot provides flexibility to the scraper and guide ring. A series of cylindrical openings defining scrap exhaust cylinders 34 extend from the back of the lubrication chamber 24 through the rear wall 35 of the plunger tip 8. As seen in FIGS. 3 and 4, the centerlines of the scrap exhaust cylinders 34 are parallel to the longitudinal centerline of the plunger tip 8. FIGS. 3 and 4 also disclose a central opening in the plunger tip 8 defining a cylindrical space 36 within the plunger tip 8. A cylindrical conduit 37 extending through the connecting rod 9 is used to circulate a coolant to control the temperature of the plunger tip 8.

Figure 5:
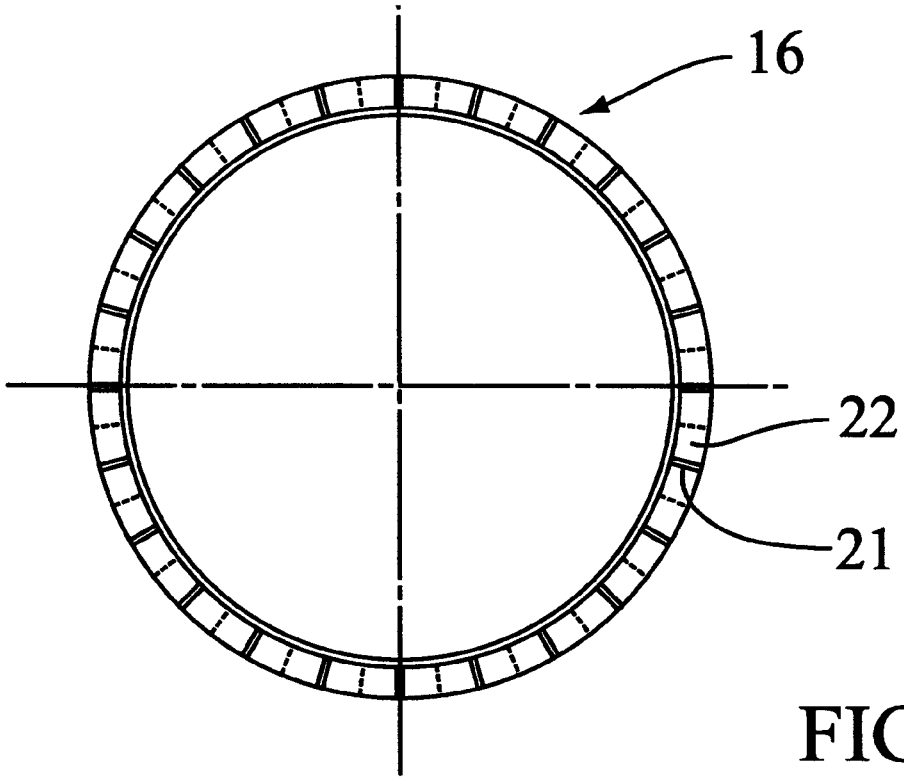
FIG. 5 is a top view of the plunger piston ring for the plunger tip showing a series of equally special slots commencing in the front side of the plunger piston ring.
Figure 6:
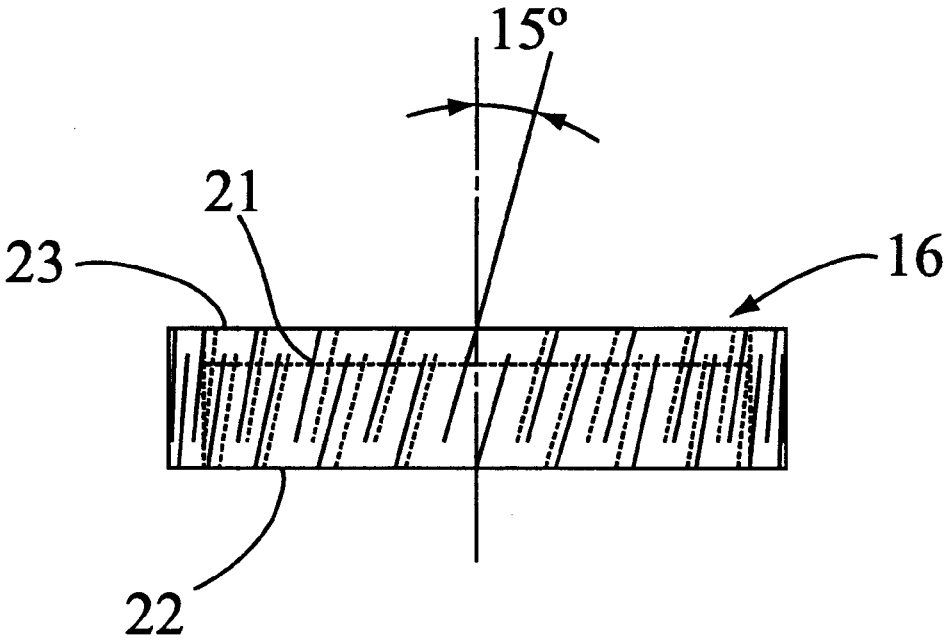
FIG. 6 is a side view of the plunger piston ring for application to the plunger tip showing a number of alternately disposed parallel inclined slots in the injection piston ring commencing alternately on the front and rear sides of the plunger piston ring.

Referring to FIG. 5, there is disclosed a plunger piston ring 16 having a series of inclined parallel slots 21 with alternate slots 21 commencing from the front 22 and rear 23 sides of the plunger piston ring 16. The slots 21 are inclined at 15° relative to a plane on the longitudinal centerline of the plunger piston ring 16. The slots 21 extend from the front 22 or rear 23 of the plunger piston ring 16. The slots 21 extend from the front 22 or rear 23 of the plunger piston ring 16 two-thirds to three-quarters of the distance towards the opposite side of the plunger piston ring 16. The multiple slots 21, forty-eight in number, are twenty thousands of an inch wide. The multiple parallel inclined alternate slots provide flexibility but no passage from the front side through to the rear side of the plunger piston ring. The plunger piston rings 16, are machined from tool steel. After cutting the slots 21 in the injection piston ring 16 the injection piston ring 16 is metal hardened, finished and subsequently nitrided.

Figure 7:
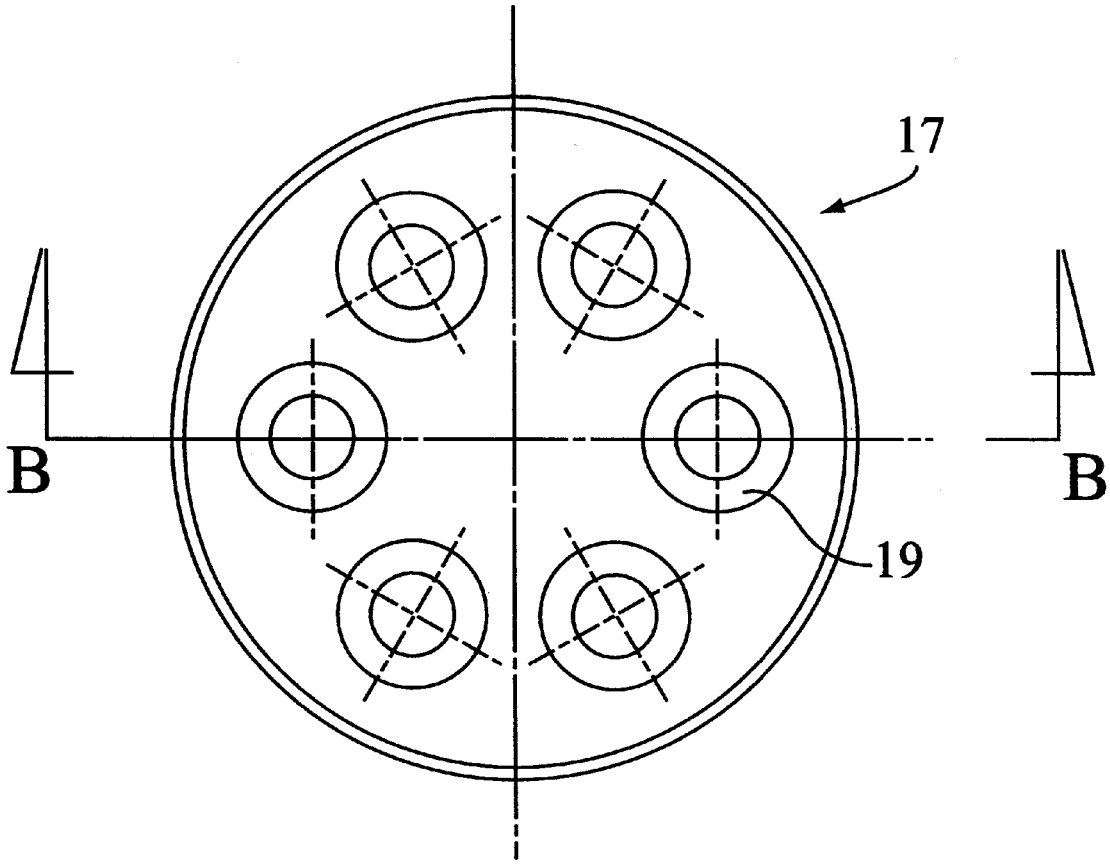
FIG. 7 is a top view of the retaining cap for the plunger tip showing a series of equally spaced countersink holes.
Figure 8:
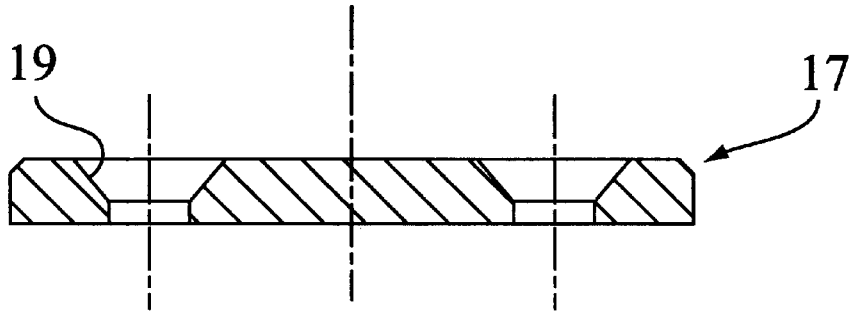
FIG. 8 is a cross-sectional view of the retaining cap for the piston ring.

The cap 17 shown in FIGS. 7 and 8 is also machined from tool steel so that the cap 17 and injection piston ring 16 which are in contact with one another have the same coefficient of thermal conductivity. The plunger piston ring 16 is mounted sliding fit into the injection sleeve 6.

The plunger tip 8 machined from high strength beryllium copper mold alloy has a higher coefficient of thermal conductivity than tool steel. The cap 17 and plunger piston ring 16 made of tool steel have a lower coefficient of thermal conductivity than the alloy of the plunger tip to keep the molten metal in the injection sleeve liquid during filling and injection. The high strength beryllium copper alloy of the plunger tip 8 has a high coefficient of thermal conductivity which enables the tip 8 to be cooled by water circulating through the central base of the plunger tip 8. The high strength beryllium copper alloy of the plunger tip 8 provides peak hardness and superior wear resistance compared to that of tool steels.

The alternate opposed inclined parallel slots 21 in the plunger piston ring provide the plunger piston ring 16 with flexibility so that if the injection sleeve 6 becomes uneven due to thermal expansion the outside of the plunger piston ring 16 remains in contact with the inside wall of the injection sleeve 6. The flexibility of the injection piston ring 16 provides less wear on the inside of the injection sleeve 6 than conventional thermal tips without plunger piston rings or split rings which permit some molten metal to bypass the split rings when they are subject to thermal expansion and pressure. The position of the injection piston ring 16 at the front outside corner of the plunger tip 8 provide a guiding advantage for the plunger tip 8. When the injection piston ring 16 and the injection sleeve 6 wear, the invention provides for easy removal of the plunger piston ring 16 and substitution of the same or a slightly larger plunger piston ring 16. The worn plunger piston ring is removed by removal of the threaded retaining bolts 18, removal of cap 17, removal of piston ring 16 and substitution of a new plunger piston ring 16, which may be the same size or slightly larger depending on sleeve wear and condition, which is then secured to the plunger tip 8 as earlier described.

In operation, the cycle commences with the injection unit 2 in the fill position shown in FIG. 1. As seen in FIG. 2 the travelling left hand side platen and travelling die half 5 are open and a sufficient distance from the stationary right hand side platen 3 and stationary die half 4 to permit molten metal to be poured into the injection sleeve 6. Molten metal is poured into the open injection sleeve 6. The molten metal in the injection sleeve 6 is in contact with the sides of the injection sleeve 6, cap 17, and the edge of the plunger piston ring 16. The cap 17 and the plunger piston ring 16 are machined from tool steel which has a low coefficient of thermal conductivity relative to the plunger tip 8. The low coefficient of thermal conductivity of the cap 17 and the plunger piston ring 16 assist in maintaining the molten metal in contact with the cap 17 and plunger piston ring 16 in a fluid state.

When the pouring of the molten metal into the injection sleeve 6 is complete, the travelling left hand side platen and travelling die half 5 close on stationary right hand side platen 3 and stationary die half 4. Following closing the die halves are clamped shut and the injection unit 2 moves from the open position shown in FIG. 1 to the injection position shown in FIG. 2. As the injection unit 2 moves upwardly in injection sleeve 6 the scraper and guide ring 33 of injection plunger 8 scrapes any metal scores located on the inside of the injection sleeve 6 into the lubrication chamber 24.

As the injection unit 2 moves from the fill position shown in FIG. 1 to the injection position shown in FIG. 2 the molten metal is forced from injection sleeve 6 into die halves 4 and 5. When the molten metal has solidified the clamping pressure is released and lubrication mixed with air is blown onto the surface of the injection sleeve 6 through inclined lubrication and air nozzle 26 and radial lubrication and air nozzles 25. The inclined lubrication and air nozzles 26 are directed at the injection sleeve 6 immediately behind the plunger piston ring 16. As the inclined lubrication and air nozzles 26 and radial lubrication and air nozzles 25 are located around the circumference of the generally arcuate annular recess in plunger tip 8, all the surface of the injection sleeve 6 facing the lubrication chamber 24 is lubricated. Following termination of clamping pressure and commencement of lubrication the injection unit 2 is withdrawn from the injection position shown in FIG. 2 to the fill position shown in FIG. 1. When the injection unit 2 reaches the fill position, the lubrication is turned off and the injection unit 2 is ready for commencement of the next sequence.

Following release of clamping pressure after the molten metal has solidified the moving platen and travelling die half 5 are withdrawn from the fixed platen 3 and fixed die half 4.

The injection piston comprised of the plunger tip 8, the flexible plunger piston ring 16 and cap 17 are effective in preventing molten metal from bypassing plunger piston ring 16 through which molten metal under pressure may escape.

The plunger piston ring 16 does not provide any path through the plunger piston ring 16. The location of inclined lubrication and air nozzles 26 and radial lubrication and air nozzles 25 about the circumference of the generally arcuate annular recess in the plunger tip 8 provides for lubrication of all the inner surface of the injection sleeve 6 facing the lubrication chamber 24. The scraping and removal of debris through exhaust conduits 34 during the injection stroke decreases wear of the surface injection sleeve 6 and the plunger piston ring 16.

The invention in its broadest aspect relates to a plunger tip 8 having a lubrication chamber 24 with inclined lubrication and air nozzle 26 and radial lubrication and air nozzles 25 about the generally arcuate annular recess in the plunger tip 8. While the invention in its broadest aspect has been described in association with a plunger tip 8 having a plunger piston ring 16 and a cap 17, it will be recognized by those skilled in the art that the lubrication chamber 24 together with inclined lubrication and air nozzles 26 and radial lubrication and air nozzles 25 about the generally arcuate annular recess in the plunger tip 8 may be utilized as part of plunger tips utilizing other means to prevent molten aluminum to pass between the plunger tip 8 and the injection sleeve 6.

What is claimed is:

1. A method of cleaning and lubricating an injection sleeve and plunger tip during a fill and injection cycle of a cold chamber die casting machine, the plunger tip having an annular generally arcuate recess, lubricating nozzles, lubricating conduits and scrap exhaust conduits, comprising releasing pressurized air into the annular generally arcuate recess in the plunger tip upon completion of the injection cycle, releasing a mixture of pressurized air and lubricant through the annular generally arcuate recess in the plunger tip onto the injection sleeve during a withdrawal cycle, terminating release of the mixture of pressurized air and lubricant into the annular generally arcuate recess in the plunger tip at the termination of the withdrawal cycle.

2. The method of claim 1, further comprising; inclining at least one of the lubricating nozzles to direct lubricant at the injection sleeve.

3. The method of claim 1, further comprising; inclining some of the lubricating nozzles to direct lubricant at the injection sleeve.

4. The method of claim 1, further comprising; orientating at least one of the lubricating nozzles radially outwardly to direct lubricant at an interior of the injection sleeve.

5. The method of claim 1, further comprising; orientating some of the lubricating nozzles radially outwardly to direct lubricant at an interior of the injection sleeve.

6. The method of claim 1, further comprising; orientating at least one of the scrap exhaust conduits parallel to a longitudinal centerline of the plunger tip.

7. The method of claim 1, further comprising; orientating the scrap exhaust conduits parallel to a longitudinal centerline of the plunger tip.

8. The method of claim 1, further comprising; providing the annular generally arcuate recess from behind a front of the plunger tip to forward of a rear of the plunger tip.

9. The method of claim 1, further comprising; providing some of the lubricating nozzles annularly about a longitudinal centerline of the plunger tip.

10. The method of claim 1, further comprising; connecting at least one of the lubricating nozzles to lubrication conduits.

11. The method of claim 1, further comprising; connecting the lubricating nozzles to lubricating conduits.

12. The method of claim 1, further comprising; orientating some of the lubricating nozzles to direct lubricant at an inclination to the injection sleeve, and orientating other of the lubricating nozzles radially outwardly to direct lubricant at an interior of the injection sleeve.

13. The method of claim 6, comprising; orientating some of the lubricating nozzles to direct lubricant at an inclined angle to the injection sleeve, and other of the lubricating nozzles radially outwardly to direct lubricant at an interior of the injection sleeve.

14. The method of claim 6, comprising; orientating some of the lubricating nozzles to direct lubricant at an inclined angle to the injection sleeve, and at least one other of the lubricating nozzles radially outwardly to direct lubricant at an interior of the injection sleeve.

15. The method of claim 6, further comprising; orientating at least one of the lubricating nozzles to direct lubricant at an inclined angle to the injection sleeve, and other of the lubricating nozzles radially outwardly to direct lubricant at an interior of the interior sleeve.

16. The method of claim 1, further comprising; connecting at least one of the scrap exhaust conduits to a rear interior of the generally arcuate annular recess and a rear surface of the plunger tip.

* * * * *

UNITED STATES PATENT AND TRADEMARK OFFICE

CERTIFICATE OF CORRECTION

PATENT NO. : 6,354,359 B2 
DATED : March 12, 2002
INVENTOR(S) : Guido Perrella and Jean Coronado It is certified that error appears in the above-identified patent and that said Letters Patent is hereby corrected as shown below:

Column 3,
Line 58, replace the word "principle" with the word -- principal --.

Column 4,
Line 6, replace the word "special" with the word -- spaced --.

Signed and Sealed this

Eighteenth Day of June, 2002

*Attest:*

*Attesting Officer*

JAMES E. ROGAN
*Director of the United States Patent and Trademark Office*